US005943829A

United States Patent [19]

Wilson

[11] Patent Number: 5,943,829

[45] Date of Patent: Aug. 31, 1999

[54] WALL AND MOLDING PROTECTOR FOR CARPET INSTALLATION

[76] Inventor: Roger D. Wilson, 10635 Winterhawk, Boise, Id. 83709

[21] Appl. No.: 09/015,023

[22] Filed: Jan. 28, 1998

Related U.S. Application Data

[60] Continuation-in-part of application No. 08/767,891, Dec. 17, 1996, Pat. No. 5,819,481, which is a division of application No. 08/500,523, Jul. 11, 1995, Pat. No. 5,584,149.

[51] Int. Cl.[6] ..... E04B 1/00

[52] U.S. Cl. ..... 52/98; 52/287.1; 118/504; 118/505

[58] Field of Search ..... 52/98, 287.1; 118/502, 118/504, 505; 427/282; 428/40, 130, 156

[56] References Cited

U.S. PATENT DOCUMENTS

| | | | |
|---|---|---|---|
| 3,430,402 | 3/1969 | Gaiser | 52/287.1 |
| 3,514,914 | 6/1970 | Bergquist | 52/287.1 X |
| 3,633,542 | 1/1972 | Read et al. | 118/505 |
| 3,693,589 | 9/1972 | Knox | 118/504 |
| 3,752,304 | 8/1973 | Alef | 118/505 X |
| 4,051,808 | 10/1977 | Trupp | 118/504 |
| 4,263,355 | 4/1981 | Sarkisian | 428/124 |
| 4,357,898 | 11/1982 | Fehrenbacher | 118/505 X |
| 4,536,913 | 8/1985 | Morowski | 118/504 X |
| 4,564,970 | 1/1986 | Latraverse | 118/504 X |
| 4,835,026 | 5/1989 | Horiki et al. | 428/40 |
| 5,014,486 | 5/1991 | Mayle | 52/288.1 X |
| 5,040,346 | 8/1991 | White | 52/287.1 |
| 5,164,238 | 11/1992 | Horiki et al. | 428/43 |
| 5,184,445 | 2/1993 | Hoopengardner | 52/741.1 |
| 5,230,738 | 7/1993 | Wheeler | 118/505 X |
| 5,584,149 | 12/1996 | Wilson | 52/98 |
| 5,819,481 | 10/1998 | Wilson | 52/98 |

FOREIGN PATENT DOCUMENTS

| | | | |
|---|---|---|---|
| 366514 | 5/1990 | European Pat. Off. | A47K 10/16 |
| 2198941 | 6/1988 | United Kingdom | A47G 27/00 |
| 2290993 | 1/1996 | United Kingdom | B05C 21/00 |

*Primary Examiner*—Beth Aubrey
*Attorney, Agent, or Firm*—Ken J. Pedersen; Barbara S. Pedersen

[57] ABSTRACT

Embodiments of a carpet layer's aid for protecting floor baseboards or walls during carpet installation, along with methods for using the aid, are shown and described. The carpet layer's aid may be an elongated strip with one of more fold lines. The strip is folded at the fold line(s) to create an anchor portion that acts as a stand for the aid and/or that further protects a baseboard by conforming to the outer shape of the baseboard. The anchor portion is inserted into the corner space, created between the floor and a baseboard and between the wall and the tack strip. Preferably, the shield portion of the aid, which extends up to cover the baseboard, includes an adhesive on its back surface for adhering to the baseboard or wall. The anchor portion may be folded to create a variety of shapes: for example, an obtuse L-shape for placing the anchor portion back beneath the bottom of the baseboard; a right-angle L-shape for providing a leg for the strip to sit on against the floor; a V-shape for extending deeply back into the corner space as well as forward to touch the tack strip side surface. One or more fold-line may be made in a manner so as to create a separating means, for allowing the user to tear or otherwise separate and remove part of the elongated strip after installation of the carpet. Alternatively, the elongated strip may be folded in shapes that allow it to be completely removed after carpet installation, that is, because the anchor portion may slide out from between the carpet and the baseboard without dislodging the carpet edge.

14 Claims, 13 Drawing Sheets

WALL AND MOLDING PROTECTOR FOR CARPET INSTALLATION

DESCRIPTION

This application is a continuation-in-part of my prior, application, WALL AND MOLDING PROTECTOR FOR CARPET INSTALLATION, Ser. No. 08/767,891, filed Dec. 17, 1996, and issued on Oct. 13, 1998 as U.S. Pat. No. 5,819,481, which is a division of application Ser. No. 08/500,523, of the same title, filed on Jul. 11, 1995, and issued on Dec. 17, 1996 as U.S. Pat. No. 5,584,149, which applications are herein incorporated by reference.

BACKGROUND

1. Field of the Invention

This invention relates generally to protecting floor baseboards or walls from damage during the installation of wall-to-wall carpet. More specifically, this invention relates to a temporary baseboard or wall protector which is easily and quickly removable after the carpet is installed, and which may, in some embodiments, be reused several times.

2. Description of the Related Art

U.S. Pat. No. 4,263,355 (Sarkisian) discloses an elongated plastic, L-shaped paint shield for protecting the edge of a carpet or floor while painting walls. This shield was intended to protect carpeting already in place prior to painting the wall. In addition, the paint shield is completely removed upon completing the painting.

U.S. Pat. No. 3,633,542 (Read et al.) discloses a plastic paint shield having a curved longitudinal edge that is inserted between the edge of the carpet and the baseboard during painting. The Read et al. shield also has a longitudinal central portion for covering and protecting the edge and the top surface of the carpet from paint damage. This shield is also intended to be completely removed when the painting is complete.

U.K. Patent Application GB2198941-A (Darenth Vending Services) discloses a carpet edge/skirting protector. This protector includes a rigid, hinged elongate member that extends under a tack strip and up along a skirting board, and a second elongate member having a socket end that attaches to the hinged member. The socketed member can pivot at the socket down to overlay the carpet or up to protect the skirting board.

The instant invention fulfills a previously unmet need by allowing carpet to be installed easily and quickly without damaging walls or existing baseboards. Neither the Sarkisian, Read et al., nor Darenth patents/patent application contemplated a use other than protecting existing carpet or flooring from paint. In addition, upon completing the carpet installation with some embodiments of the instant invention, a small portion of the disclosed invention is left behind under the carpet, unlike the Sarkisian and Read et al. devices, which are completely removed. Unlike Darenth, the instant invention is simple and economical to use and, in several of its embodiments, may be reused.

SUMMARY OF INVENTION

The present invention is a carpet layer's aid for protecting floor baseboards, walls, or other building surfaces during carpet installation. The protector comprises an elongated strip of sheet material with one or more separating means and/or one or more folding means, for being used between a tack strip and a baseboard, wall, or other building surface. The elongated strip is preferably a sheet that is flat before folding and has, generally, a shield portion for protecting the baseboard or wall, and an anchor portion for being received into the space between the baseboard (or wall) and the tack strip to kelp the strip in place during use. There may be separating means for allowing a part of the strip to be torn away after installation of the carpet, leaving the remainder of the strip behind hidden by the carpet. There may be fold lines scored or perforated into the strip for allowing the strip to be folded to a shape beneficial for holding the strip anchor portion in place in the space between the baseboard and tack strip. The fold-line separating anchor portion from shield portion preferably is folded at between about 90°–150° to make the anchor portions extend out of the vertical plane of the shield portion to create a "stand" which tends to stabilize and anchor the strip without it being attached to the floor or tack strip. Alternatively, the fold may place the anchor portion out of the shield portion's plane, to hold the anchor portion in a more convenient position for working with the carpet, for example, "tucked" out of the way under the baseboard.

The fold-lines are preferably made in such a manner so that the strip does not break apart or become "floppy" at the folds, that is, although folded, the strips's integrity is generally preserved until purposely torn.

The preferred protector comprises no attachment to a tack strip or floor, but may removably and/or temporarily contact the tack strip or floor. Additionally, there may be self-stick adhesive on one or more sides of the strip for placement against the baseboard (or wall) to further hold the strip in place for protection of the baseboard or wall.

During the installation of a carpet, the elongated strip provides an economical and convenient way of protecting the building surfaces that are adjacent to the edge of the carpet. By using the invented protector, the building surface is protected from scratches and gouges that can otherwise result from the stretching, cutting, and tucking of the carpet.

DESCRIPTION OF THE PREFERRED EMBODIMENT

The disclosed invention is a carpet layer's aid or "protector" for protecting floor baseboards or walls during carpet installation. The aid comprises a generally flat, elongated strip of sheet material, for example fiberboard or cardboard, having approximately a 90 or 120 pound weight. The specific type of sheet material used is not important, but the sheet material must be thick enough to protect the baseboard or wall from accidental marks. Preferably, the sheet material is thin enough to be folded and separated using the separating means, and thin enough to be scored by conventional scoring equipment to create fold lines at which the sheet material may be easily folded and substantially retained in the folded shape.

The elongated strip is preferably 5 to 9 inches wide and about 48 inches long, for convenience of installation and to match the length of the typical tack strip. Preferably, the elongated strip has greater than a 5/1 ratio of length to width. Other sizes of elongated strip may be used, however, the elongated strip must be sufficiently wide, so that, when it is folded at the separation means and/or fold lines, the upwardly extending shield portion is tall enough to protect the baseboard or bottom of the wall while carpet is being laid. An alternative embodiment may be of the same width as the precut embodiments, but in bulk roll lengths.

The preferred embodiments of the invention feature an anchor portion which is received in the space between the baseboard (or wall) and the tack strip. This space is an elongated generally rectangular space in an end view, bound by the wall, and the side of the tack strip, and the bottom of the baseboard and the floor. The anchor portion may comprise various combinations of perforations and/or scoring, preferably parallel to and near a first longitudinal edge of the protector. These perforations and/or scoring may serve to provide separation means and/or fold-lines for forming the various embodiments portrayed in the Figures. Additionally, embodiments of the protector may include perforations and/or scoring parallel to the second, opposite, longitudinal edge, so that the protector may be removed after the first use, turned around, and re-used a second or even a third and fourth time.

Figure 1:
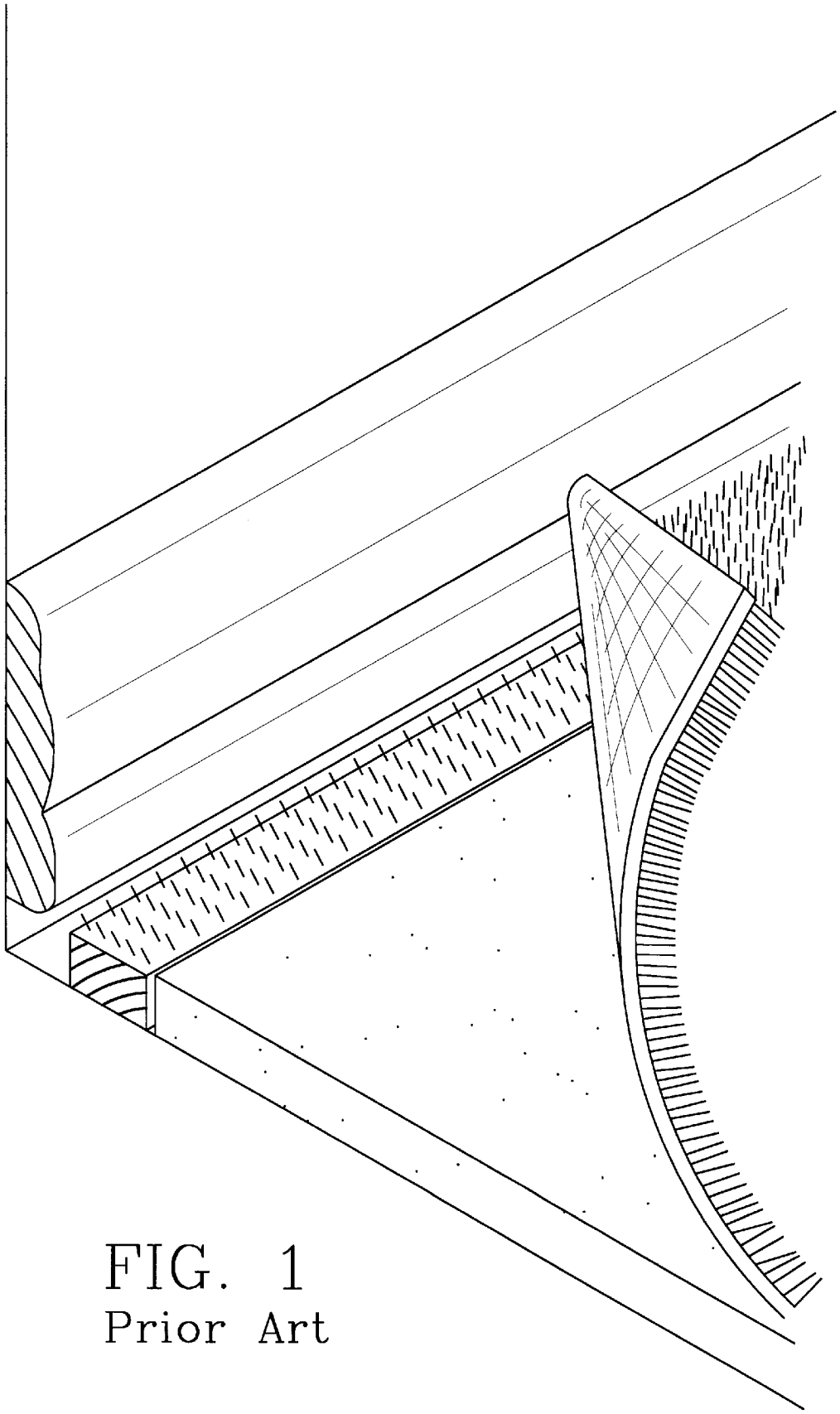
FIG. 1 Prior Art
FIG. 1 is a partial perspective view of a typical wall-to-wall carpet installation, with the carpet pulled away from the tack strip and baseboard.
Figure 2:
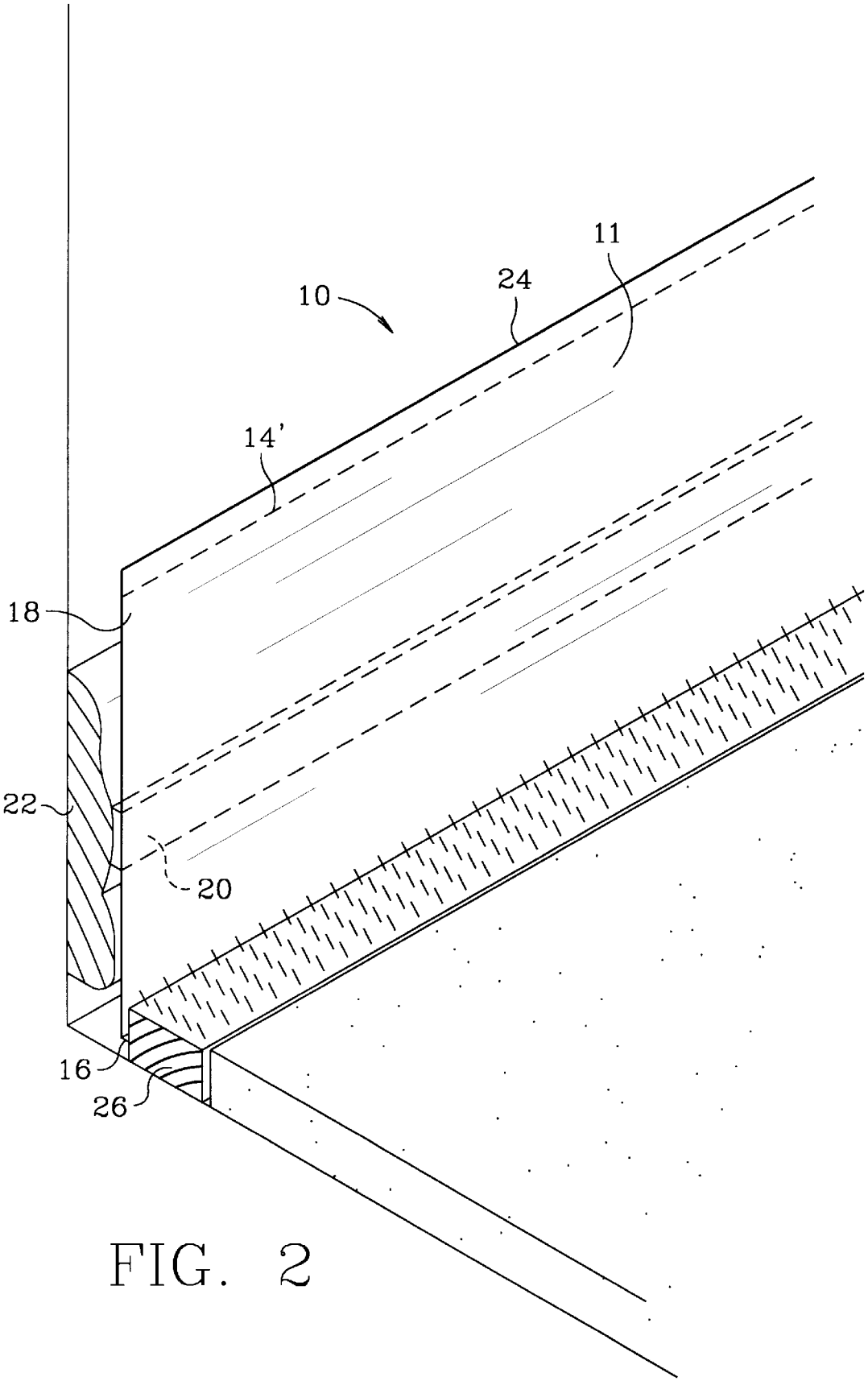
FIG. 2 is a partial perspective view of one embodiment of the invention, an L-shaped protector inserted between the baseboard and the tack strip, and having an area of self-adhesive material on its back, and a perforation near its second edge for a use a second time.
Figure 3:
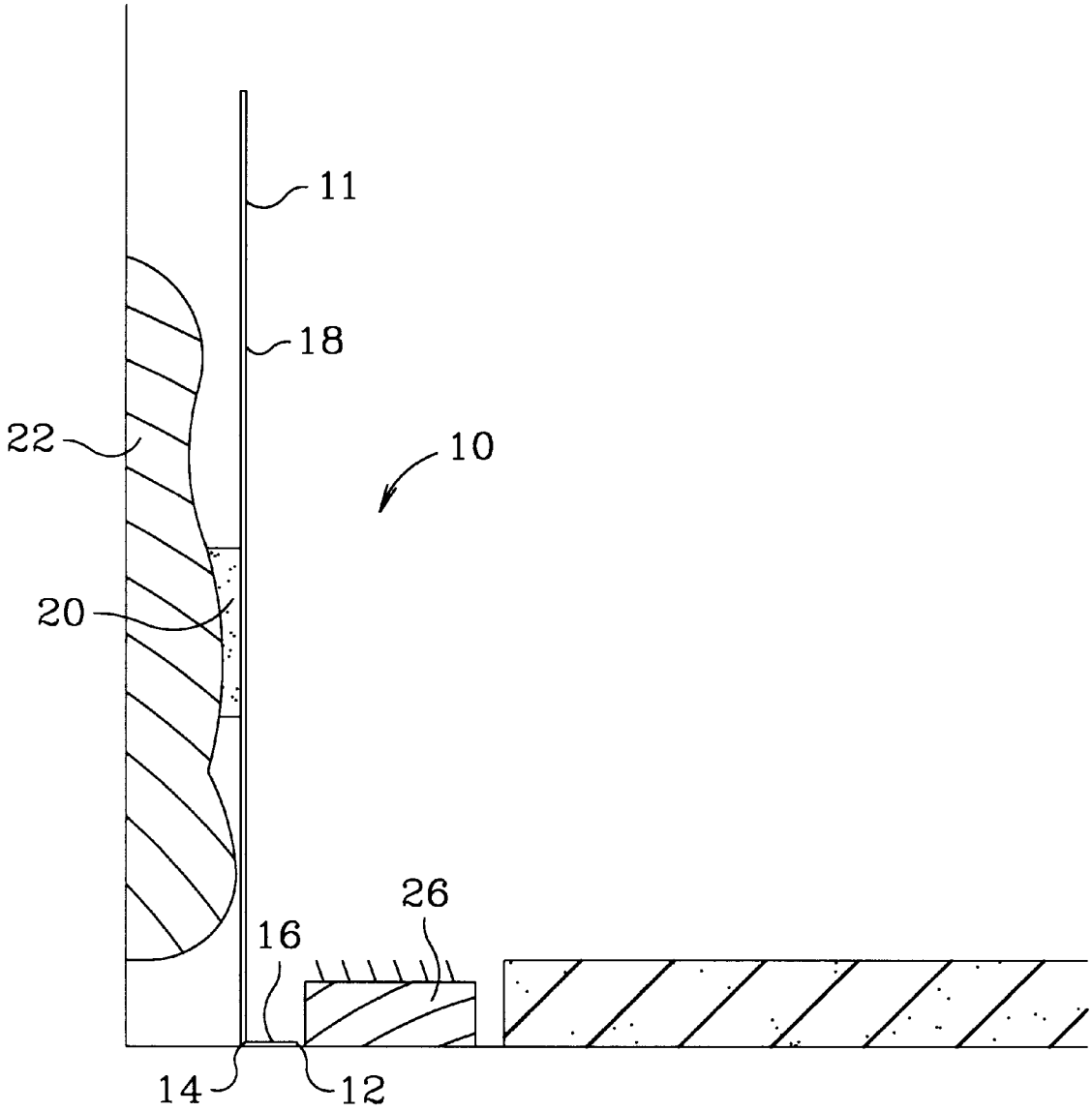
FIG. 3 is a cross-sectional side view of the embodiment of FIG. 2.

Referring to FIGS. 2 and 3, the carpet layer's aid or protector 10 is an elongated strip 11 folded into generally an L-shape. A row of perforations 14 is included near (about ¼–½ inches, and preferably ⅜ inches, from) the first edge 12 of the elongated strip, and the strip 11 folded at those perforations into the L-shape. The anchor portion 16, therefore, is generally parallel to the floor, and the perforations 14 separate the strip 11 into the horizontal anchor portion 16 and the generally vertical shield portion 18. Preferably, this protector 10 includes a strip of self-adhesive 20 or other self-stick material on the back of the shield portion 18, for being pushed against the baseboard 22 to further stabilize the protector to prevent damage to the baseboard. In the version shown in FIG. 2, optional perforations 14' parallel to and near the opposite longitudinal edge 24 may be added to make the protector "reversible", that is, after one use, it may be switched around for use of the second edge 24 by folding the second row of perforations 14' into an L-shape.

In the L-shaped embodiment of FIGS. 2 and 3, the anchor portion 16 is preferably sized to fit into the space between the baseboard 22 and the tack strip 26, without causing the shield portion 18 to be bent or curved, but rather keeping the shield portion generally straight and vertical. In the Figures, the adhesive shown schematically emphasizes the resulting connection to the baseboard.

Figure 4:
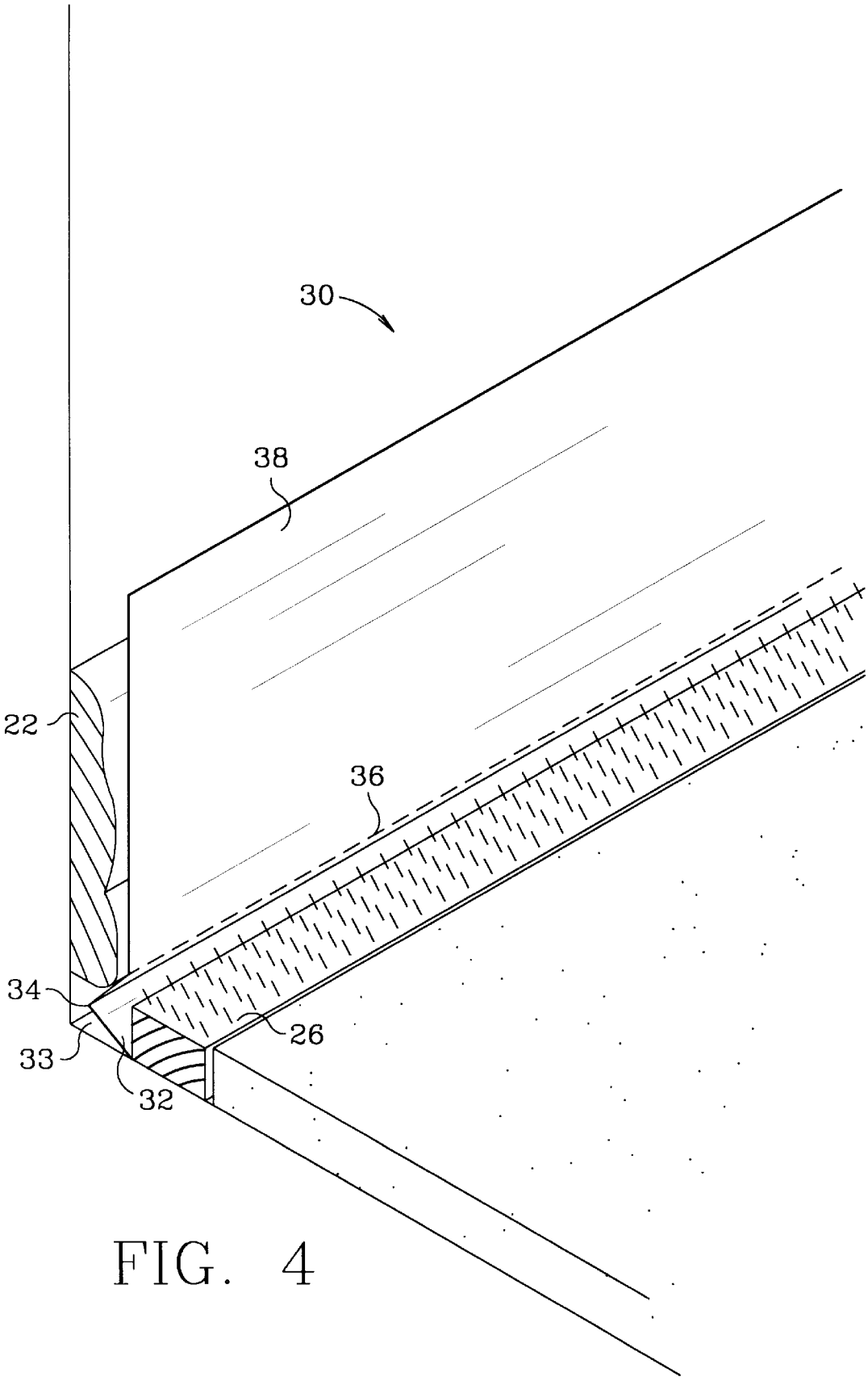
FIG. 4 is a partial perspective view of an alternative embodiment having a double-fold for creating a V-shaped anchor portion.
Figure 6:
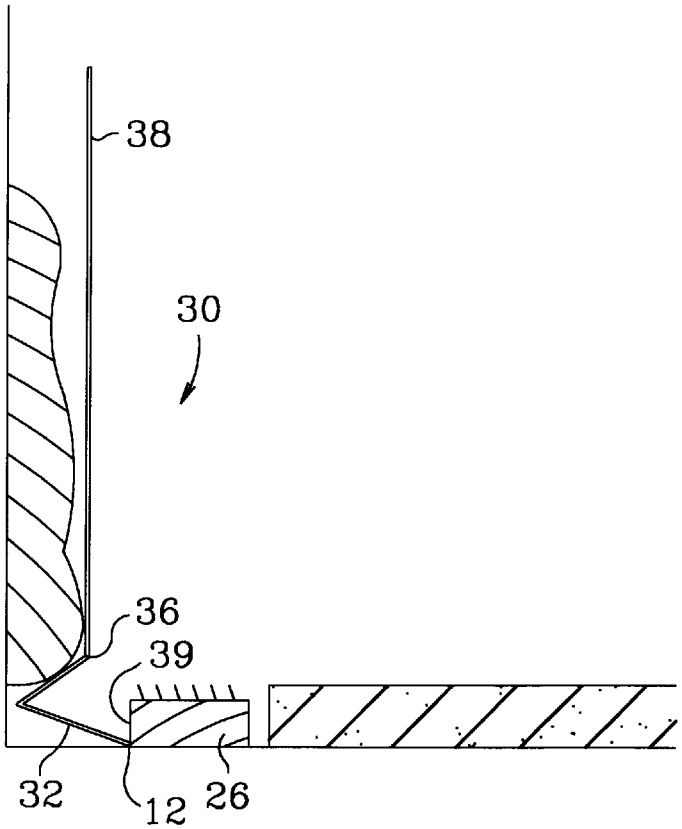
FIG. 6 is a cross-sectional side view of the embodiment of FIG. 4.
Figure 5:
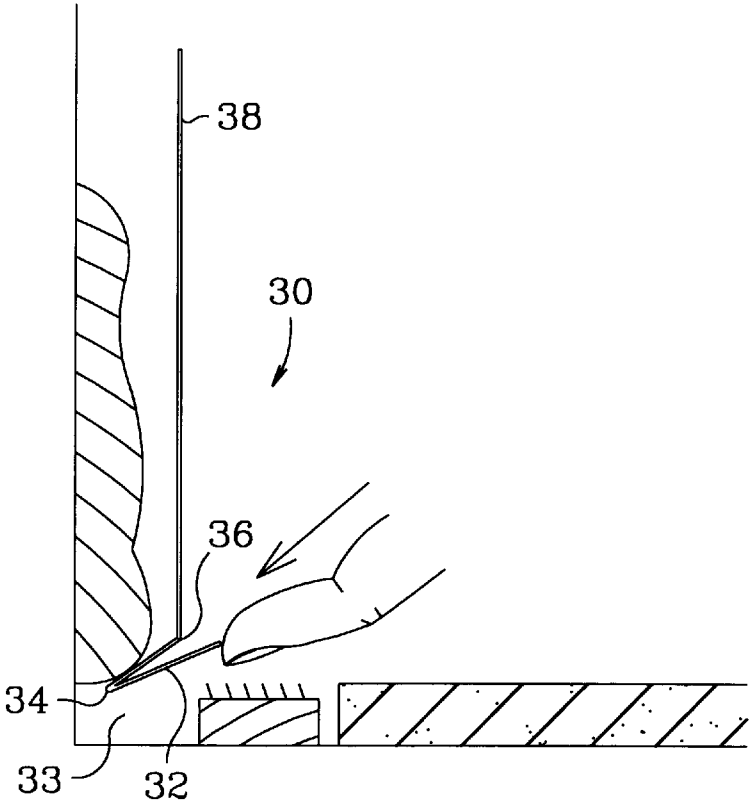
FIG. 5 is a cross-sectional side view of the embodiment of FIG. 4, being inserted into the space between the baseboard and the floor and between the wall and the tack strip.
Figure 7:
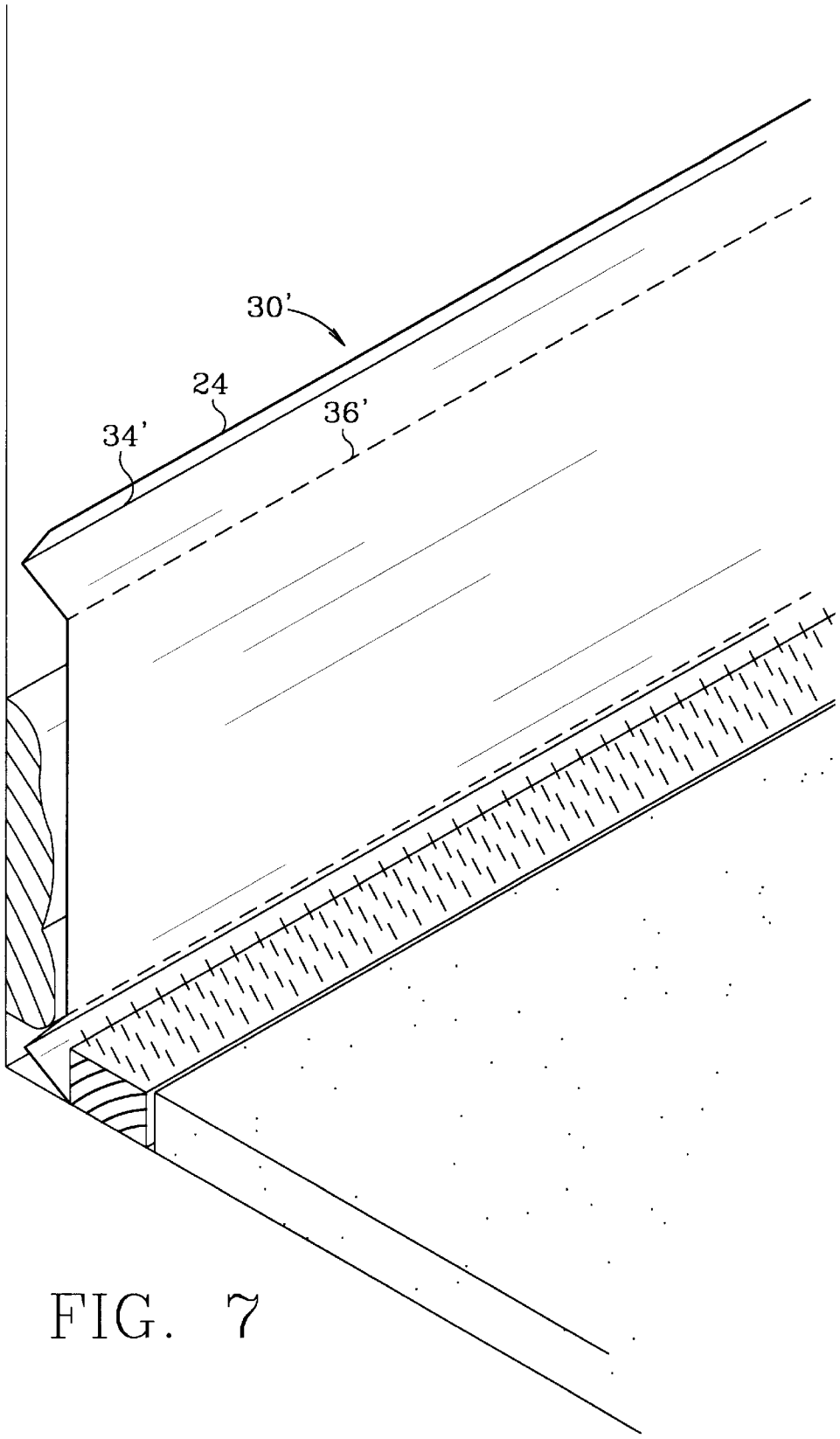
FIG. 7 is a partial perspective view of an alternative embodiment of a double-fold protector, with separation means and double folds near each longitudinal edge of the protector.

Referring to FIGS. 4–6, an alternative embodiment 30 includes a V-shaped anchor portion 32 received in the space 33 between the baseboard and the tack strip. The anchor portion 32 is formed by a fold 34 at the scoring line near the first longitudinal edge and by a second fold at the perforation line 36 that serves as the separation means between the anchor portion 32 and the shield portion 38. FIGS. 5 and 6 illustrate installation of this embodiment, with the "point" of the V being inserted deep into the comer area below the baseboard bottom surface and the longitudinal edge 12 abutting against the side surface 39 of the tack strip 26. After installation of the carpet, this protector 30 would preferably be separated at the perforations 36 by the installer pulling the shield portion 38 up and to the side, to tear the shield portion off and to leave the V-shaped anchor portion 32 behind, underneath and hidden by the carpet edge. Optionally, this embodiment may include an additional scoring line 34' and, optionally, an additional perforation line 36', both near the second longitudinal edge 24, as shown in FIG. 7. This FIG. 7 configuration allows the protector 30' to be reused at least one more time, with the second longitudinal edge 24 being inserted into the area below the baseboard, in a similar manner to FIG. 4. Optionally, adhesive tape or other self-sticking material may be added to the back of the protector for adherence to the baseboard.

Figure 8:
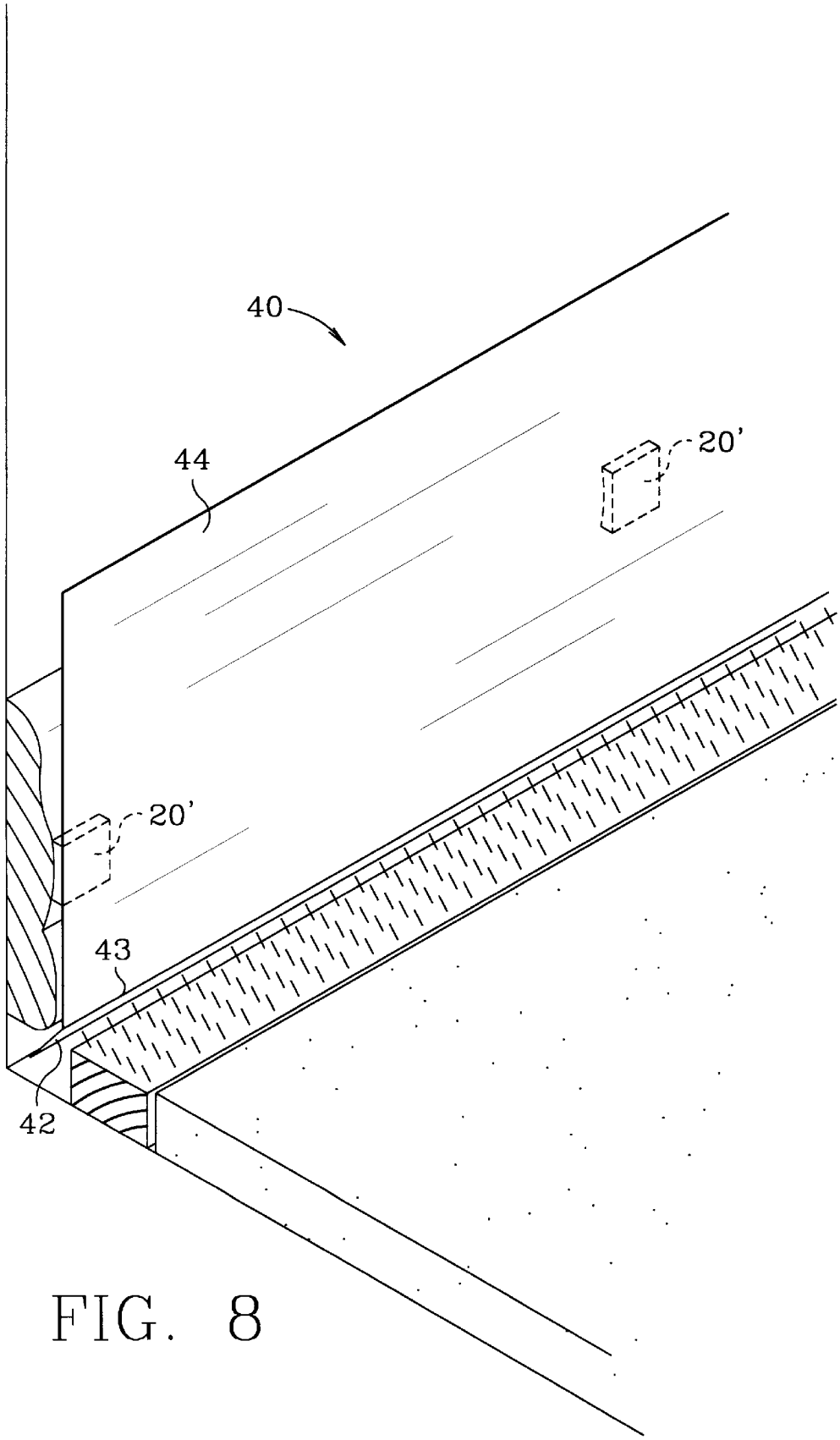
FIG. 8 is a partial perspective view of another embodiment of the invention.
Figure 9:
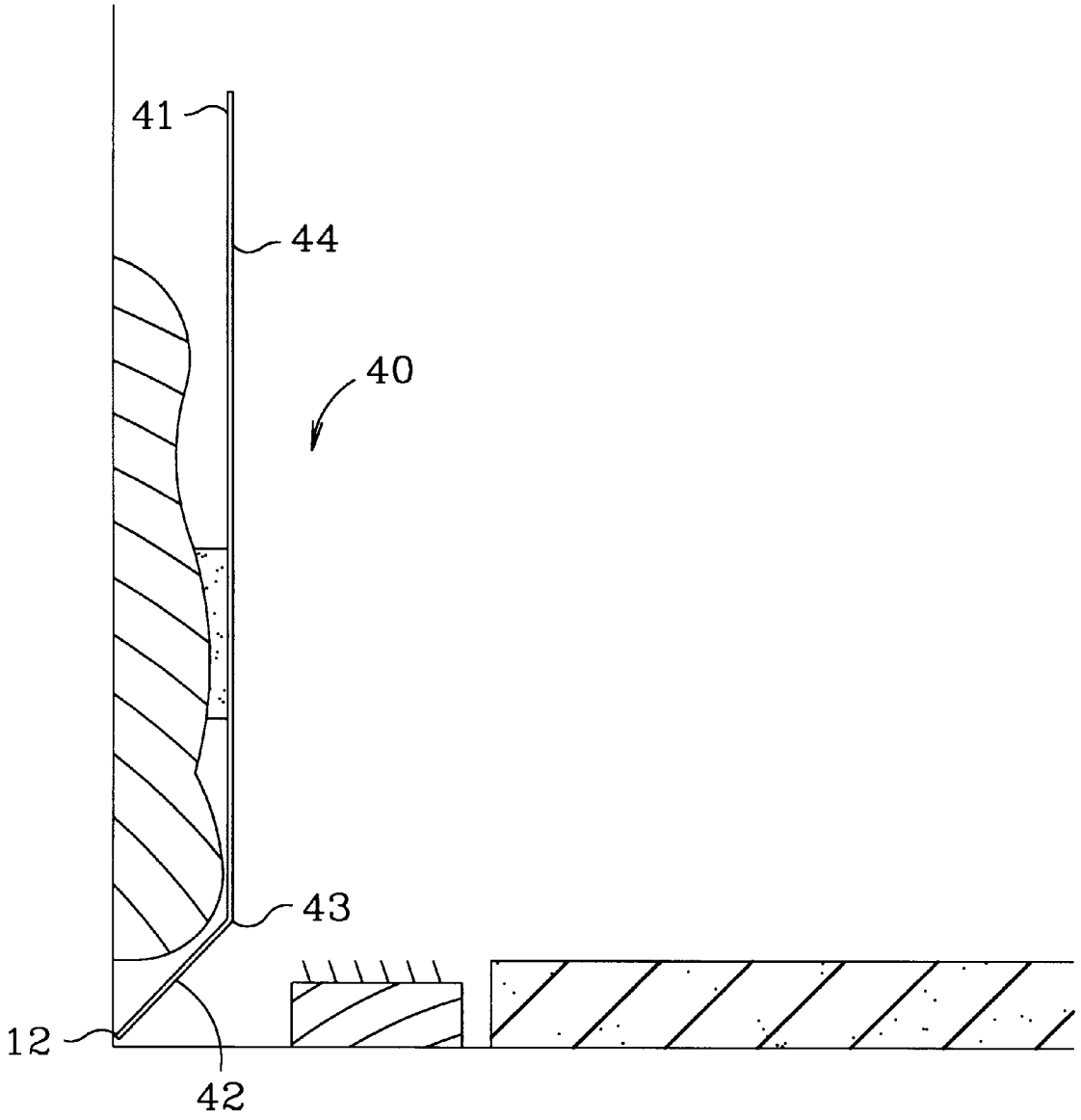
FIG. 9 is a cross-sectional side view of the embodiment of FIG. 8.
Figure 10:
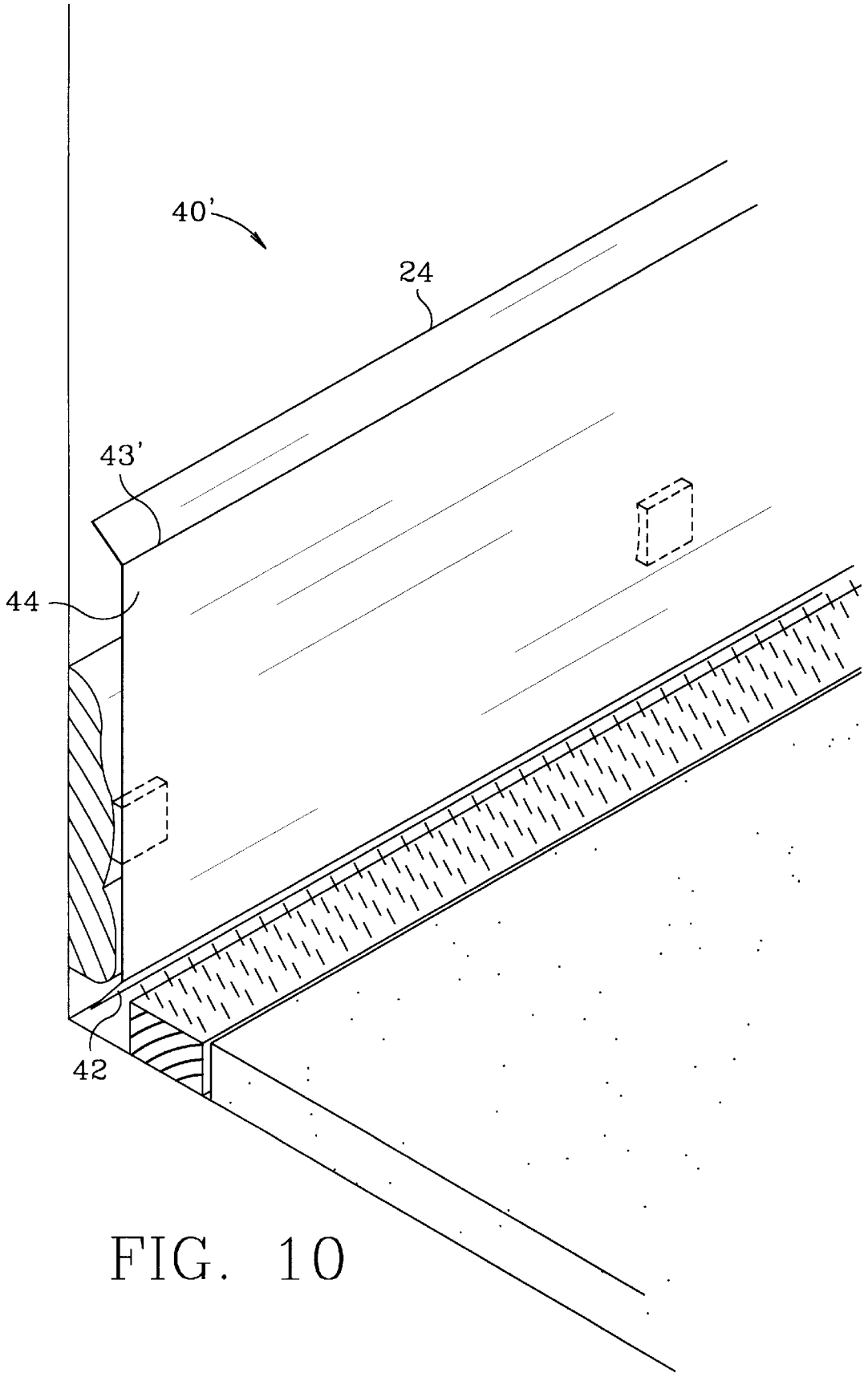
FIG. 10 is a partial perspective view of an alternative version of the embodiment of FIG. 8, including similar folds on each longitudinal edge of the protector.

Referring to FIGS. 8 and 9, an alternative protector 40 includes a single scoring line 43 at about 1–1½ inches from the first longitudinal edge 12, so that the strip may be folded at an obtuse angle of about 135° (about 120°–150°), so that the strip extends at about 45° (30°–60°) to the floor into the area below the baseboard. This protector includes self-adhesive 20' on the back surface 41, so that the combination of the edge 12 of the 45° angled anchor portion 42 resting on the floor and the self-adhesive on the shield portion 44 serve to secure the protector while the carpet is being installed. During carpet installation, this embodiment minimizes interference with the carpet and tools, and minimizes the leverage put on the strip, which might otherwise dislodge it, because the anchor portion is out of the way under the baseboard. After carpet installation, this protector 40 is normally pulled out from the carpet, without leaving a portion behind. FIG. 10 shows an alternative version of the protector 40', which includes a second scoring line 43' near the second longitudinal edge 24 for a subsequent uses. Optionally, perforations or deep scoring may be used rather than fold-style scoring, allowing the shield portion 44 to be torn away from the 45° angled portion 42 after carpet installation.

Figure 11:
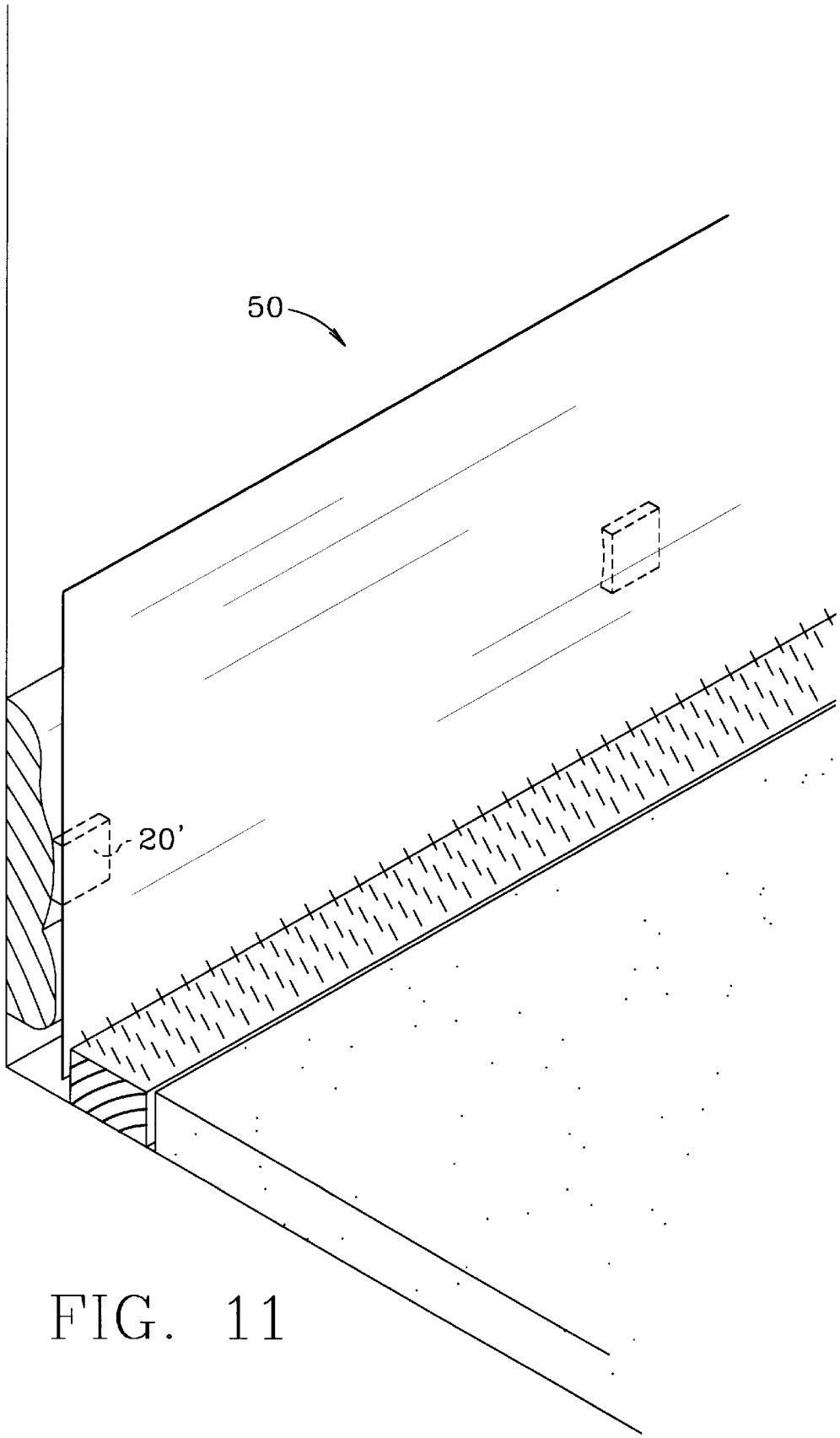
FIG. 11 is a partial perspective view of an alternative embodiment of the invention, wherein a generally straight protector with adhesive on the back, with one protector longitudinal edge being pushed into the space between the baseboard and the tack strip.
Figure 12:
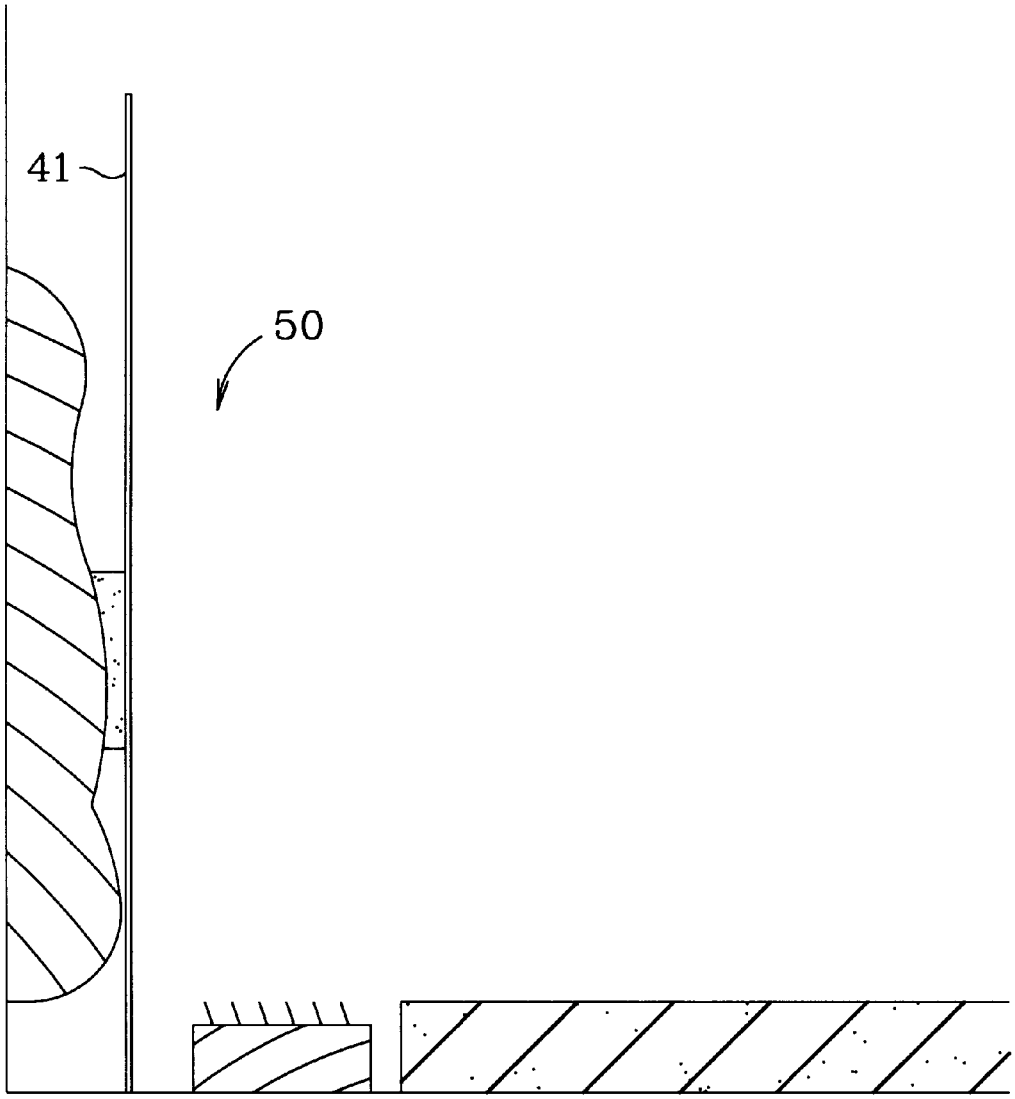
FIG. 12 is a cross-sectional side view of the embodiment of FIG. 11.

In FIGS. 11 and 12, a straight protector 50 with self-adhesive 20' on the back surface 41 is shown. This may be a first use protector, or, alternatively, FIG. 11 may portray a shield portion of another protector, for example, of FIGS. 4 or 8, that has been torn away from an anchor portion and then reused as a straight protector. Optionally, this and the other embodiments of the invention may have additional perforation or scoring lines near the second edge for folding or tear-away.

The above protectors may be said to have anchor portions, which are delineated either by perforations or scoring, other weakenings or crimpings of the sheet, or even two sheets attached to each other by a layer of adhesive. The anchor portions in the above embodiments are characterized by being received by or engaged in the space between the baseboard and the tack strip, but not necessarily attached to or connected to the tack strip or engaged by the stack strip, the floor, the baseboard or any other structure. These embodiments are particularly useful for cases in which the tack strip is already present, so that the installer need not attach the protector to the tack strip, but rather let the protector "sit" in or be frictionally wedged in space 33 and preferably adhesive 20, 20' temporarily retains the shield portion against the baseboard.

Figure 13:
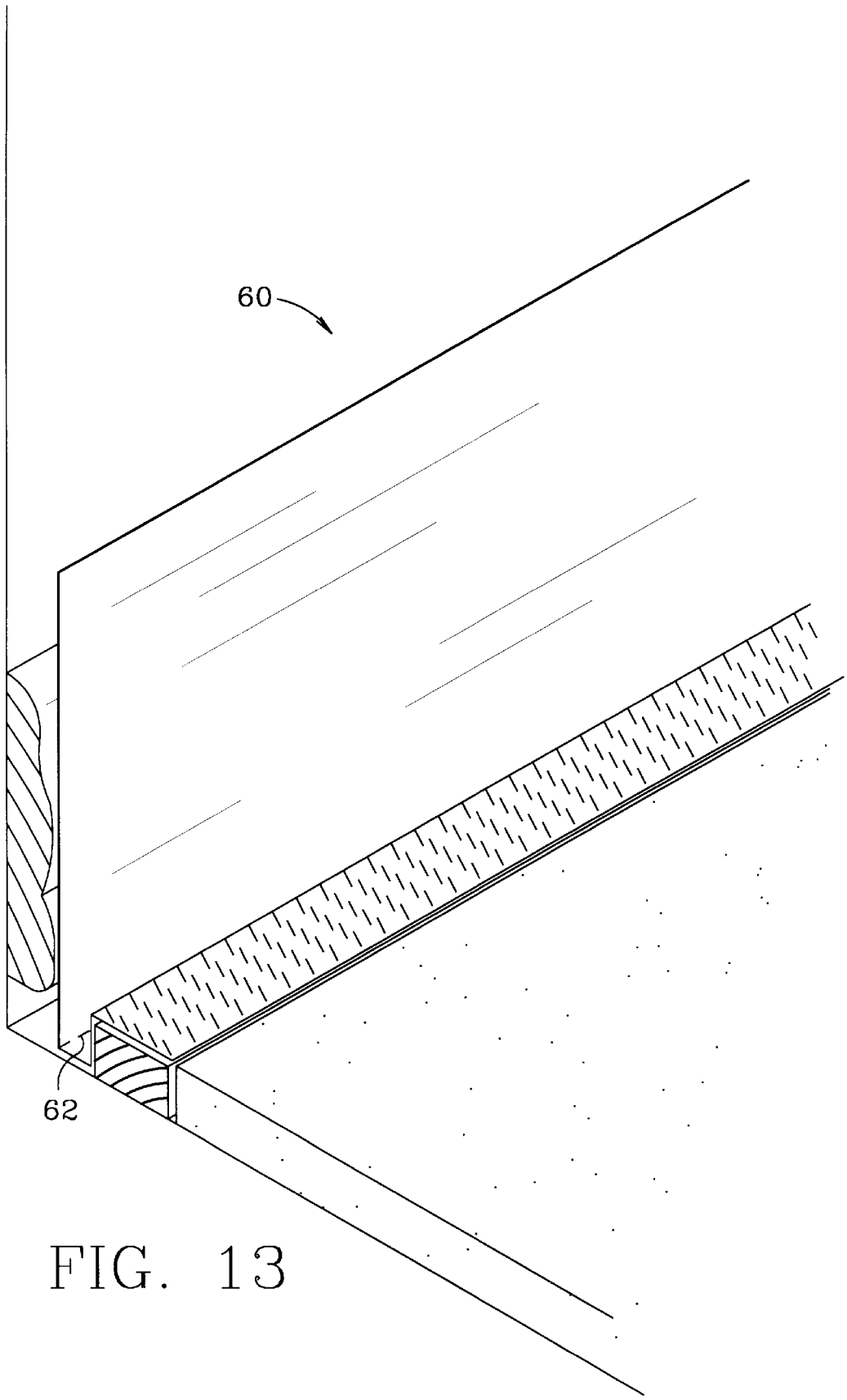
FIG. 13 is a partial perspective view of an alternative embodiment of the invention, with the anchor portion being folded to generally conform to the space between the baseboard and the tack strip and also extending across the top of the tack strip.
Figure 15:
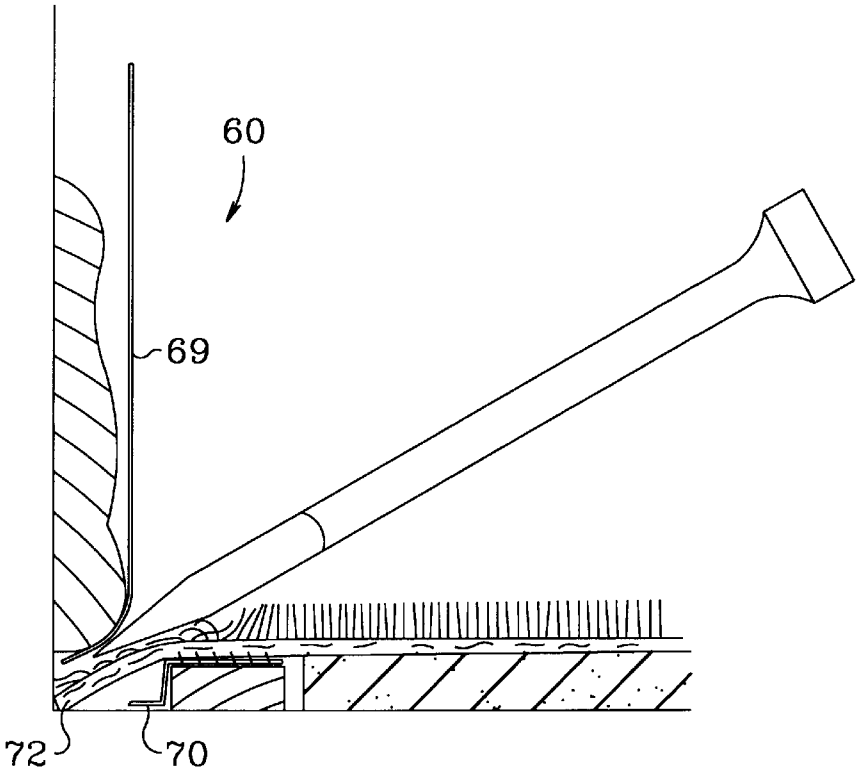
FIG. 15 is a cross-sectional side view of the embodiment of FIGS. 13 and 14, shown with a carpet installation tool pushing the carpet edge into the space between the baseboard and the tack strip and breaking the separation means of the protector.
Figure 14:
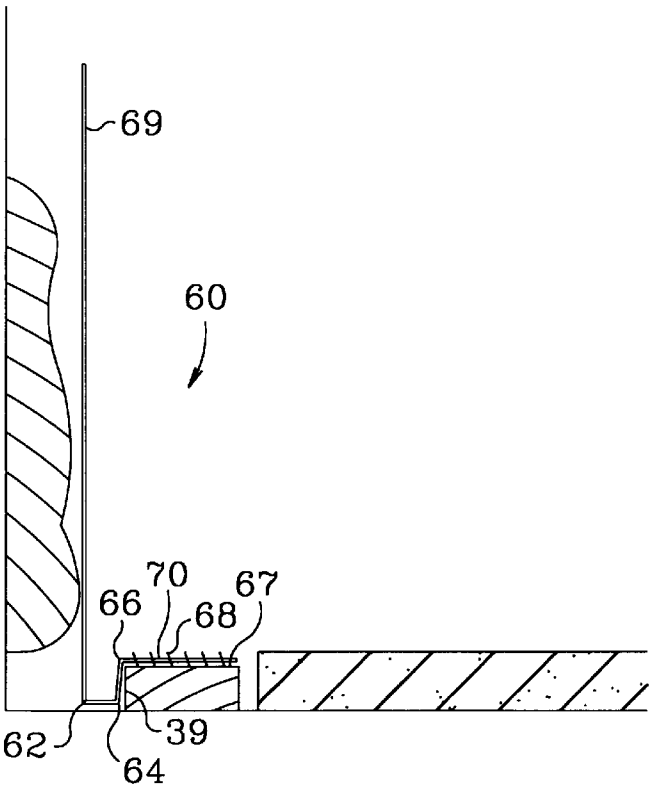
FIG. 14 is a cross-sectional side view of the embodiment of FIG. 13.

An alternative embodiment shown in FIG. 13 shows a protector 60 that includes a perforation line 62 for folding and separation of the anchor portion from the shield portion, plus two fold-lines 64, 66, preferably produced by scoring to contour the anchor portion along the floor, up the side 39 of the tack strip, and along the top 67 of the tack strip. Preferably, the protector 60 is pushed down over the tacks 68 of the tack strip, so that the anchor portion is attached to the top of the tack strip. After carpet installation, the shield portion 69 is pulled away, leaving the anchor portion 70 against the floor and tack strip. FIGS. 14 and 15 show a method of breaking through the perforations 62 with a carpet installation tool when the carpet 72 is being forced into the space below the baseboard. Although cardboard is the preferred material for the strip, others may be used. A single sheet made of two layers may be used, for example, a sheet having a barrier layer of tough but flexible plastic and a layer of foam, permanently bonded together. Such a two-layer material is described in U.S. Pat. No. 5,443,885 (Wilson), and available from Protecta Industries of Nampa, Id. Various thicknesses of plastic film and foam may be used, preferably in the range of about 20–30 mil thick plastic film and 1/16–1/4 inch thick foam. Such a composition effectively shields a baseboard or wall and may be scored, perforated, and bent.

Although the preferred use of the invented carpet layer's aid protector is for protecting vertical baseboards or walls during carpet installation, the invention also includes use of the strip on any building surface and for installation of any floor covering. Although this invention has been described above with reference to particular means, materials and embodiments, it is to be understood that the invention is not limited to these disclosed particulars, but extends instead to all equivalents within the scope of the following claims.

I claim:

1. A carpet layer's system comprising:

a baseboard attached to a wall near a floor and having a generally vertical outward surface;

a tack strip having a bottom surface and a side surface, the tack strip bottom surface connected to the floor at a distance from the baseboard creating a space between the baseboard and the tack strip side surface; and an elongated strip having a longitudinal axis, and first and second longitudinal edges parallel to said longitudinal axis, the elongated strip having a fold line in the strip generally parallel to the first longitudinal edge, and the elongated strip being folded at an angle at said fold line to create an anchor portion of the strip extending from the fold line to the first longitudinal edge and a shield portion extending from said fold line to said second longitudinal edge; wherein said anchor portion is received in said space between the baseboard and the tack strip side surface;

wherein said shield portion extends upwards from said space and extends generally vertically beside said outward surface of the baseboard; and wherein said elongated strip is not attached to the tack strip, and does not extend between the floor and the tack strip.

2. The carpet layer's system as in claim 1, wherein the elongated strip has a back surface and the strip further comprises an adhesive on the back surface contacting and adhering to the outward surface of the baseboard.

3. The carpet layer's system of claim 1, wherein the elongated strip is folded at an obtuse angle at said fold line.

4. The carpet layer's system of claim 1, wherein the elongated strip is folded at about a 90° angle at said fold line.

5. The carpet layer's system as in claim 1, wherein the anchor portion has at least one additional fold line and the anchor portion is folded at an angle at each fold line.

6. The carpet layer's system as in claim 5, wherein the elongated strip has a back surface and the strip further comprises an adhesive on the back surface contacting and adhering to the outward surface of the baseboard.

7. The carpet layer's system as in claim 5, wherein the anchor portion is folded at said fold lines into a V-shape having a point defined by one of the fold lines, and wherein the point is located in the space and the strip first longitudinal edge contacts the tack strip side surface.

8. The carpet layer's system as in claim 1, wherein the fold line comprises perforations in the elongated strip.

9. The carpet layer's system as in claim 1, wherein the fold line comprises scoring in the elongated strip.

10. The carpet layer's system as in claim 1, wherein the strip is folded at the fold line at about 135°, and wherein said anchor portion extends into the space and towards the wall.

11. The carpet layer's system of claim 1, wherein the strip is folded at about a 90° angle and the anchor portion extends parallel to the floor and toward the side surface of the tack strip.

12. A carpet layer's system comprising:

a baseboard attached to a wall near a floor and having a generally vertical outward surface;

a tack strip having a bottom surface and a side surface, the tack strip bottom surface connected to the floor at a distance from the baseboard creating a space between the baseboard and the tack strip side surface; and an elongated strip having a longitudinal axis, and first and second longitudinal edges parallel to said longitudinal axis;

wherein said first longitudinal edge is received in said space between the baseboard and the tack strip side surface near the floor;

wherein said elongated strip extends upwards from said space and extends vertically beside said outward surface of the baseboard, the elongated strip further having a back surface and an adhesive on the back surface contacting and adhering to the outward surface of the baseboard; and wherein said elongated strip is not attached to the tack strip, and does not extend between the floor and the tack strip.

13. A carpet layer's method comprising:

providing an elongated strip of material having a longitudinal axis, and first and second longitudinal edges parallel to said longitudinal axis, the elongated strip having a fold line in the strip generally parallel to the first longitudinal edge, and the elongated strip being folded at an angle at said fold line to create an anchor portion of the strip extending from the fold line to the first longitudinal edge and a shield portion extending from said fold line to said second longitudinal edge;

placing the elongated strip anchor portion in a space between a baseboard and a tack strip side surface;

positioning the elongated strip shield portion vertically against a vertical outer surface of the baseboard so that the shield portion substantially covers and protects the baseboard outer surface;

installing a carpet so that an edge of the carpet extends beneath the baseboard and into the space between the baseboard and the tack strip;

removing at least the shield portion of the elongated strip away from the baseboard and carpet to uncover the baseboard.

14. The carpet layer's method as in claim 13, further comprising the reuse of the removed shield portion a second time as a carpet layer's aid, said reuse comprising:

placing a longitudinal edge of the removed shield portion into the space between a baseboard and a tack strip side surface prior to installing a carpet;

positioning the shield portion so that it extends substantially upward from said space vertically along the baseboard outer surface for protecting the baseboard; and pressing the shield portion against the baseboard to adhere an adhesive on a back surface of the shield portion onto the outer surface of the baseboard.

* * * * *